US005182813A

United States Patent [19]

Booze

[11] Patent Number: 5,182,813

[45] Date of Patent: Feb. 2, 1993

[54] NURSING GARMENT

[76] Inventor: Janice E. Booze, 1919 Wynkoop Dr., Colorada Springs, Colo. 80909

[21] Appl. No.: 826,438

[22] Filed: Jan. 27, 1992

[51] Int. Cl.[5] ..... A41D 1/20; A41D 1/22

[52] U.S. Cl. ..... 2/104; 2/105; 2/106; 450/36

[58] Field of Search ..... 2/104, 73, 88, 114, 2/115, 46, 48, 49 R, 50, 51, 73, 105, 106; 450/30, 31, 32, 33, 36, 37, 57, 56

[56] References Cited

U.S. PATENT DOCUMENTS

| | | | |
|---|---|---|---|
| 230,462 | 7/1880 | Bortree | 450/55 |
| 531,179 | 12/1894 | Gilbert | 450/36 |
| 1,206,480 | 11/1916 | Stagg | 2/104 |
| 1,309,269 | 7/1919 | Winnegrad | 2/104 |
| 2,911,650 | 11/1959 | Gerich | 2/104 X |
| 3,077,197 | 2/1963 | Garfinkel | 450/55 |
| 3,950,792 | 4/1976 | Williams | 450/54 X |
| 4,024,876 | 5/1977 | Penrock | 450/54 X |
| 4,106,122 | 8/1978 | Dodd | 2/104 |
| 4,208,743 | 6/1980 | Whitcraft | 2/104 |
| 4,280,228 | 7/1981 | Sulzmann | 2/104 |

FOREIGN PATENT DOCUMENTS

| | | | |
|---|---|---|---|
| 2157941 | 11/1985 | United Kingdom | 2/104 |
| 2170095 | 7/1986 | United Kingdom | 2/104 |

*Primary Examiner*—Werner H. Schroeder
*Assistant Examiner*—Jeanette E. Chapman
*Attorney, Agent, or Firm*—Donald W. Margolis; Edwin H. Crabtree

[57] ABSTRACT

This garment for a woman who has a need to breast feed an infant may be in the form of a hospital gown, blouse, dress, or any other type of upper body covering clothing normally worn by a woman. The garment, made of flexible material, has a vertical inwardly facing pleat centered on and along the upper front in the vicinity of the breasts of a wearer. The pleat includes and is formed by a pair of exposed exterior fold lines and a pair of normally hidden interior fold lines, with an inwardly facing pleat face disposed between the interior fold lines. Along a portion of the interior fold lines are normally hidden openings which are positioned to allow an infant access to the breasts of the wearer. A pair of movable breast cover panels are attached along opposite side of the inwardly facing pleat face. The movable breast cover panels are adapted to be moved away from the normally hidden openings to expose the breasts of the wearer for breast feeding an infant when the exterior fold line portion of the pleat is folded away from the center of the garment to make the normally hidden openings visible. When the wearer is not breast feeding an infant, the cover panels are held in place in a manner which covers and conceals the breasts of the wearer from view through the openings, even when the wearer leans forward, or when the garment otherwise droops away from her upper body.

18 Claims, 1 Drawing Sheet

NURSING GARMENT

BACKGROUND OF THE INVENTION

1. Field of the Invention

The subject invention relates to a piece of upper body clothing to be worn by a mother who will be engaged in breast feeding an infant.

2. Background of the Invention

In the following U.S. Pat. Nos. 907,290 to Rouff; 1,098,155 to Knapp; 1,206,480 to Stagg; 2,911,650 to Gerich; 4,280,228 to Sulzman; 4,458,365 to Wood; 4,566,136 to Echols; 4,601,068 to Frechette; and 4,660,227 to Abramson, various types of nursing garments, nursing blouses, and nursing gowns are disclosed. Each of these prior art garments have openings therein through which an infant may obtain access to the breast of the wearer for feeding. In substantially every one of these prior art garments the openings have some form of mechanical closure using, for example buttons, snaps, zippers, Velcro hook and loop material, and the like. None of the above mentioned prior art patents disclose or teach a nursing garment which may be made in various styles, patterns, and shapes, and which has a vertical pleat centered on and along the length of the front of the garment, which pleat includes and is formed by a pair of exposed exterior fold lines and a pair of hidden interior fold lines with an inwardly facing pleat face disposed between the interior fold lines, and with a normally hidden opening along a portion of each interior fold line positioned to provide an infant access to the breasts of the wearer. Furthermore, none of the above described prior art provides such a garment having a pair of movable breast cover panels connected to opposite sides of such a normally hidden inwardly facing pleat face, which cover panels are held in place by interior connections to conceal the breasts of the wearer from view through the openings during normal wearing conditions.

SUMMARY OF THE INVENTION

In view of the foregoing, it is an object of the present invention to provide an attractive garment for covering the upper body which provides easy access for an infant to the breast of a women for breast feeding.

Another object of the invention is to provide such garments in various styles, patterns and shapes, such as a hospital gown, blouse, dress, and any other type of upper body clothing, while still providing the function of allowing a mother to breast feed her infant with ease.

Still another object of the invention is the provision of such a garment having an inwardly facing inverted V-shaped pleat down the front and center of the garment, which pleat provides no outward indication that the garment also includes openings for breast feeding an infant.

Yet another object of the nursing garment is the use with such a garment of movable breast cover panels which are designed to further conceal the breast of the wearer when she leans forward or when the garment otherwise droops away from her the upper body.

The subject nursing garment fabric is composed of a flexible material, typically having a vertical inverted V-shaped pleat centered on and along the length of a front of the garment. The pleat includes a pair of exposed exterior fold lines and a pair of normally hidden interior fold lines with an inwardly facing pleat face disposed between the interior fold lines. Along a portion of each normally hidden interior fold line is a slash or slit opening for allowing access by an infant to the breasts of the wearer. A pair of interior movable breast cover panels are provided adjacent to opposite sides of the inwardly facing pleat face. The cover panels are held in place by interior elastic bands or by interior stiching connected to the interior of the garment. The breast cover panels are designed to conceal the breasts of the wearer during normal wearing conditions, for example when the wearer leans forward or when the garment otherwise droops away from her upper body. The garment may be made in various styles, patterns, and shapes and constructed of different types of flexible fabric.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENT

Figure 1:
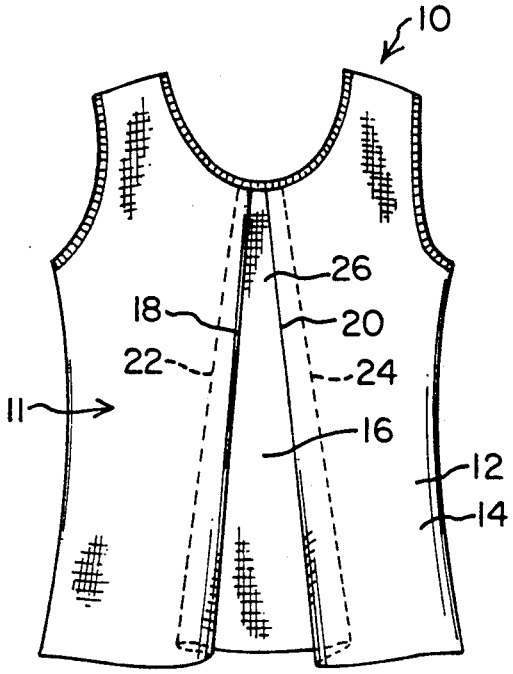
FIG. 1 is a front elevational view of the subject invention, partially in phantom, and shown in the form of a hospital nursing gown, and as it would appear during normal wearing conditions.

Referring to FIG. 1, a front view of the subject nursing garment is shown having general reference numeral 10. The garment 10 is made, for example of a flexible fabric 12, and in this illustration is shown as a hospital gown with an open neck and without sleeves. A front 14 of the garment 10 includes a vertical, inwardly facing, inverted V-shaped inwardly facing pleat 16 along the length thereof. The pleat includes a pair of exterior fold lines 18 and 20 and a pair of normally hidden fold lines 22 and 24, as shown in phantom in FIG. 1. A pleat face 26 is disposed between and along the length of the interior fold lines 22 and 24.

Figure 2:
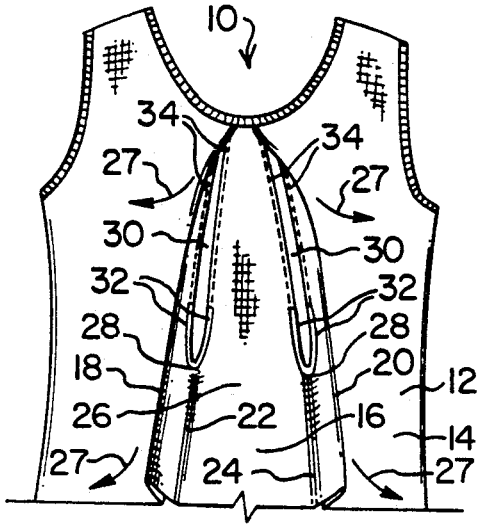
FIG. 2 illustrates a front elevational view of the nursing garment of FIG. 1 with the exterior fold lines of an inwardly facing pleat folded back to expose hidden interior fold lines and openings along the top of the interior fold lines.

In FIG. 2 a front view of the garment 10 is shown with the exterior fold lines 18 and 20 folded back, as indicated by arrows 27, to expose the normally hidden interior fold lines 22 and 24. A top portion 28 of the interior fold lines 22 and 24 is shown having openings or slashes 30 therein for providing access to a the breasts of the wearer when breast feeding and infant. The fabric 12 along the opposite sides of the slashes 30 is shown as being stabilized with stitching 34. Disposed along the lower sides of the slashes 30 is bias tape 32 for reinforcing the garment against stress at this location.

Figure 3:
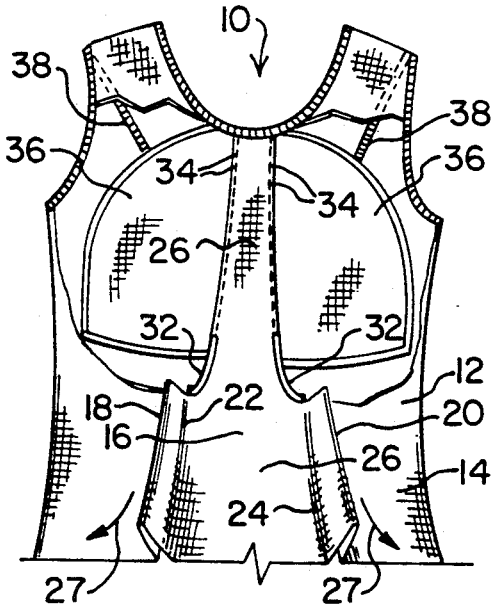
FIG. 3 is a front elevational view of the nursing garment of FIG. 1 with an upper portion of the front of the garment cut away to expose a pair of movable breast cover panels, each panel being secured to an inwardly facing pleat face.

Referring now to FIG. 3, the nursing garment 10 of the present invention is shown with an upper front portion cut away to expose a pair of movable breast cover panels 36, which breast cover panels 36 are adapted and dimensioned to cover the breasts of the wearer of the garment 10. The side of each of the breast cover panels 36 which is contiguous to one side of the [inwardly facing] pleat face 26 and adjacent the slashes 30 is connected to the pleat, for example by stitching, with the result that there is a breast cover panel 36 connected to each of the opposite sides of the pleat face 26, and away from the center of the garment. In the preferred embodiment illustrated by FIG. 3, each of the movable breast cover panels 36 is normally located to at least partially cover the shoulder and chest of the wearer within the interior of the garment. The breast cover panels 36 of FIG. 3 are held in their normal position by an elastic band 38 which has one end connected to the outer edge of the panel 36 and a second end connected to the shoulder or arm area of the interior of the garment. When the user of the garment 10 is not breast feeding her infant, should she lean forward or should the front of the garment droop away from her upper body, the breast cover panels 36 prevent the embarrassment of having one or both of the breasts exposed to view through slash openings 30.

Figure 4:
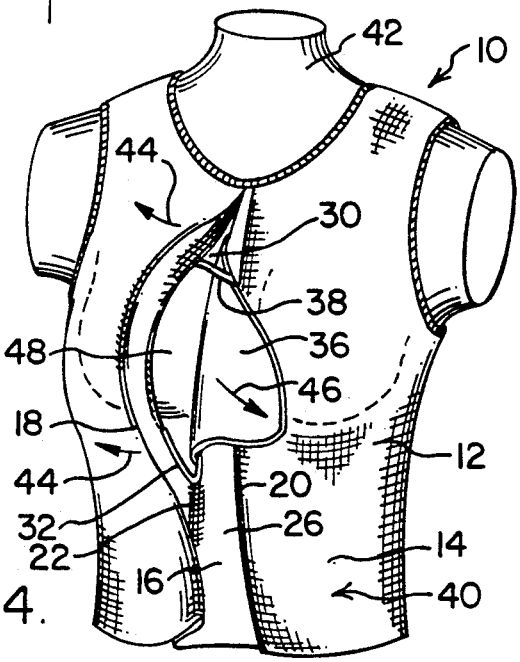
FIG. 4 is a perspective view of a blouse form of nursing garment of the present invention shown modeled on a dressmakers female form, and showing a portion of the inwardly facing pleat folded back and a breast cover panel moved out of the exposed slash to provide access to the right breast of the female form, and demonstrating how an infant would have ready access to the breast of a wearer using the subject invention.

In FIG. 4 a perspective view of the nursing garment 10 is shown as a tailored blouse 40 and modeled on a dress makers form 42, without arms or a head. In this illustration, like parts have been given like numbers as in FIGS. 1-3. The exterior fold line 18 of the inwardly facing pleat 16 is shown folded to the right, as indicated by arrows 44, to exposed the normally hidden interior fold line 22 and slash opening 30. Also the moveable breast panel cover 36 is shown moved to the left and through the slash opening 30, as indicated by arrow 46. A portion of the right breast 48 of the dress makers form 42 is thus shown to be exposed through opening 30. If the blouse 40 was being worn by a women nursing an infant, the blouse 40 would now be positioned to allow the infant to have access to the right breast of the wearer for feeding.

When the feeding of the infant is completed the moveable breast panel cover 36 would be moved inside of slash opening 30 to again cover the right breast 48, with the elastic band 38 holding the cover 36 in its normal position. The exterior fold line 18 would also be returned to its normal position, with the interior fold line 22 and slash openings 30 are once more normally hidden from view by the exterior fold line 18, similar to FIG. 1. The nursing garment 10, shown as blouse 40, may then be worn normally as any other type of female upper body covering clothing until the nursing of the infant is again required.

Figure 5:
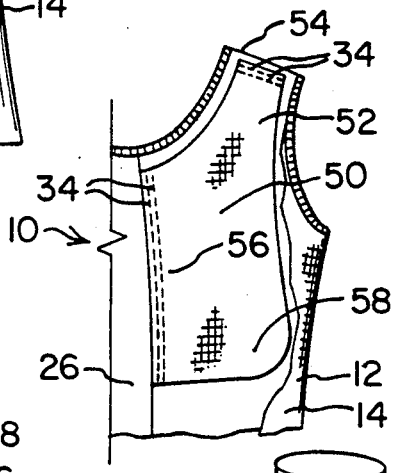
FIG. 5 is a front view of yet another embodiment of the present invention showing a portion of the left side of the nursing garment cutaway to show another form of the breast cover panels.

FIG. 5 is a front view of an alternate embodiment of the present invention. In this illustration, like parts have been given like numbers as in FIGS. 1-3. In FIG. 5 a portion of the left side of the nursing garment 10 is shown cutaway. In this view a breast panel cover 50 is shown having an upper extended portion 52 which is secured at a shoulder or arm area 54 of the garment 10 by stitching 34. A side portion 56 of the breast panel cover 50, similar to the cover panels 36, is stitched along one side of the pleat face 26. When breast feeding a child using this embodiment, a lower portion 58 of the panel cover 50 is folded and moved outwardly through the slash opening 30, not shown, in a manner such that an infant can access the breast of its mother for feeding. When the child has been feed, the panel cover 50 is unfolded and returned to its original position as shown in FIG. 5. The nursing garment 10, shown in FIG. 5 may then be worn normally as any other type of female upper body clothing, until the nursing of an infant is again required.

While only a left breast panel cover 50 is shown in FIG. 5, the right breast panel cover 50 in such a garment would be a mirror image thereof. Also, it has been found that the cover panels 50, secured by stitching 34 to the shoulder area 54, are reliably held in place for covering the breasts of a wearer during the use of the garment 10, while elastic bands 38, as shown in FIG. 3, may be subject to wear, stretching or fatigue over extended periods of use.

It is thus seen that the present invention provides a nursing garment which may be made in various styles, patterns, and shapes and constructed of different types of fabric, the nursing garment having a vertical pleat centered on and along the length of the front of the garment, which pleat includes and is formed by a pair of exposed exterior fold lines and a pair of hidden interior fold lines with an inwardly facing pleat face disposed between the interior fold lines, and with an opening along a portion of each interior fold line to provide an infant access to the breasts of the wearer. The present invention further provides such a garment having a pair of movable breast cover panels adjacent to opposite sides of the inwardly facing pleat face, which cover panels are held in place by interior connections. It is further seen that the breast cover panels of the present invention are designed to conceal the breasts of the wearer from view through the openings during normal wearing conditions, for example when the wearer leans forward or when the garment otherwise droops away from her upper body.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A nursing garment in the form of upper body clothing to be worn by a women for breast feeding an infant, said garment including a front, a back, openings for arms, and shoulder portions, said nursing garment including, in combination:

centered on said front of said garment, a substantially vertical, always open, inwardly facing pleat requiring no closure means and formed by, and including, a pair of normally visible, substantially vertical, exterior fold lines, a pair of normally hidden substantially vertical interior fold lines; and normally hidden, always open, opening means through said front of said garment at at least one of said hidden interior fold lines of said always open, inwardly facing pleat, said normally hidden, always open, opening means being located and adapted to become visible and to provide easy access to the breast of a wearer for breast feeding an infant by folding said exterior fold line portion of said inwardly facing pleat away from the center of said garment.

2. The garment as described in claim 1 wherein said inwardly facing pleat is substantially in the shape of an inverted V.

3. The garment as described in claim 1 wherein said vertical inwardly facing, always open pleat includes a pair of exposed exterior fold lines and a pair of normally hidden interior fold lines with a pleat face disposed between said interior fold lines.

4. The garment as described in claim 3 wherein each said opening means is a slash.

5. The garment as described in claim 4 further including a movable breast cover means which is adapted, dimensioned and positioned within the interior of the garment to normally cover from view through said always open, opening means the breasts of the wearer of said garment when not breast feeding an infant, and which said movable breast cover means are further adapted to be moved away from said opening means to expose the breasts of the wearer for breast feeding an infant.

6. The garment as described in claim 5 wherein each said movable breast cover means is contiguous with and connected to one side of said pleat face, away from the center of said garment, and adjacent to said opening means.

7. The garment as described in claim 6 wherein each side of said pleat face has a movable breast cover means contiguous to and connected at one side thereof and adjacent to said always open, opening means, but on opposite sides of said pleat face, away from the center of said garment.

8. The garment as described in claim 7 wherein each said movable breast cover means is normally located within the interior of said garment at least partially across the shoulder and breast of a wearer.

9. The garment as described in claim 5 further including means for normally retaining each said movable breast cover means in place over said opening means on said garment when the wearer is not breast feeding an infant.

10. The garment as described in claim 9 wherein said retaining means for said breast cover means is an elastic band which has a first and a second end, said first end being connected to an outer edge of said breast cover means while said second end is connected to the shoulder or arm area of the interior of said garment.

11. The garment as described in claim 9 wherein said retaining means for said breast cover means includes an extended portion of said cover means connected to the shoulder or arm area of the interior of said garment.

12. A nursing garment in the form of upper body clothing to be worn by a women for breast feeding an infant, said garment including a front, a back, openings for arms, and shoulder portions, said nursing garment including, in combination:

a substantially vertical, always open, inwardly facing pleat requiring no closure means and free of closure means and in the shape of an inverted-V formed by, and including, a pair of normally visible, converging, substantially vertical exterior fold lines and a pair of normally hidden, converging, substantially vertical interior fold lines, with a pleat face disposed between said interior fold lines, said inwardly facing pleat carried by and centered on said front of said garment;

normally hidden, always open, opening means through the front of said garment at each of said hidden interior fold lines of said inwardly facing pleat, said normally hidden always open, opening means being located and adapted to become visible and to provide easy access to the breast of a wearer for breast feeding an infant by folding said exterior fold line portion of said inwardly facing pleat away from the center of said garment; and movable breast cover means which are adapted, dimensioned and positioned to normally cover from view through said always open, opening means the breasts of the wearer of said garment when not breast feeding an infant, and which said movable breast cover means are further adapted to be moved away from said opening means to expose the breasts of the wearer for breast feeding an infant when said exterior fold line portion of said inwardly facing pleat is folded away from the center of said garment.

13. The garment as described in claim 12 wherein each said movable breast cover means is contiguous with and connected to one side of said pleat face, and is adjacent to said opening means, but on opposite sides of said pleat face, away from the center of said garment.

14. The garment as described in claim 13 further including means for retaining each said movable breast cover means in place over said opening means on said garment when the wearer is not breast feeding an infant.

15. A nursing garment in the form of upper body clothing worn by a women for breast feeding an infant, said garment comprising:

a flexible fabric having a vertical, always open, inwardly facing pleat requiring no closure means and centered along the front of said garment, said pleat having a pair of exposed exterior fold lines and a pair of normally hidden interior fold lines, with a pleat face disposed between said interior fold lines; and normally hidden, always open, opening means along said hidden interior fold lines for providing access to the breasts of a women for breast feeding the infant.

16. The garment as described in claim 15 wherein said normally hidden opening means are a pair of slashes in a portion of said interior fold lines.

17. The garment as described in claim 15 further including a pair of movable breast cover panels, said cover panels being attached to opposite sides of said pleat face.

18. A nursing garment in the form of upper body clothing to be worn by a women for breast feeding an infant, said garment including a front, a back, openings for arms, and shoulder portions, said nursing garment including, in combination:

centered on said front of said garment, a substantially vertical inwardly facing open pleat requiring no closure means and formed by, and including, a pair of normally visible, substantially vertical, exterior fold lines, and a pair of normally hidden substantially vertical interior fold lines;

normally hidden, opening means through said front of said garment at at least one of said hidden interior fold lines of said inwardly facing pleat, said normally hidden opening means being located and adapted to become visible and to provide easy access to the breast of a wearer for breast feeding an infant by folding said exterior fold line portion of said inwardly facing pleat away from the center of said garment; and movable breast cover means which is adapted, dimensioned and positioned within the interior of the garment to normally cover from view through said opening means the breasts of the wearer of said garment when not breast feeding an infant, and which said movable breast cover means are further adapted to be moved away from said opening means to expose the breasts of the wearer for breast feeding an infant.

* * * * *